United States Patent [19]

Bolles

[11] 4,255,992

[45] Mar. 17, 1981

[54] CARPET CUTTING METHOD

[75] Inventor: Milton M. Bolles, LaGrange, Ga.

[73] Assignee: Milliken Research Corporation, Spartanburg, S.C.

[21] Appl. No.: 40,970

[22] Filed: May 21, 1979

Related U.S. Application Data

[62] Division of Ser. No. 932,949, Aug. 11, 1978.

[51] Int. Cl.[3] ..... B26D 3/02

[52] U.S. Cl. ..... 83/23; 83/105; 83/581

[58] Field of Search ..... 83/23, 105, 162, 581, 83/878, 877, 432

[56] References Cited

U.S. PATENT DOCUMENTS

| | | | |
|---|---|---|---|
| 176,892 | 5/1876 | Rollins . | |
| 362,179 | 5/1887 | Remus | 83/877 X |
| 386,035 | 7/1888 | Riegel . | |
| 505,421 | 9/1893 | Frost | 83/432 |
| 667,055 | 1/1901 | Andersen | 83/432 X |
| 923,426 | 6/1909 | Gisriel . | |
| 1,289,485 | 12/1918 | Lewis | 83/432 X |
| 2,021,300 | 11/1935 | Gardner . | |
| 2,271,755 | 2/1942 | Albertoli . | |
| 2,705,986 | 4/1955 | Wetzel . | |
| 3,090,414 | 5/1963 | Briggs . | |
| 3,097,684 | 7/1963 | LeTarte | 83/581 X |
| 3,125,138 | 3/1964 | Bolenbach . | |
| 3,180,195 | 4/1965 | Clark . | |
| 3,364,710 | 1/1968 | Rouyer et al. . | |
| 3,608,412 | 9/1971 | Braden et al. | 83/432 X |
| 3,690,356 | 9/1972 | Holan | 83/478 X |
| 3,760,670 | 9/1973 | Poran . | |
| 4,041,818 | 8/1977 | Rummer | 83/581 X |

*Primary Examiner*—Frank T. Yost

*Attorney, Agent, or Firm*—Earle R. Marden; H. William Petry

[57] ABSTRACT

Apparatus to cut a carpet into two sections with the edge of each section being beveled. The apparatus employs two rotary cutters mounted at an angle to each other and which are driven at the same speed in the same direction.

2 Claims, 4 Drawing Figures

CARPET CUTTING METHOD

This is a division of application Ser. No. 932,949, filed Aug. 11, 1978.

Prior to this invention, rotary cutters have been employed to cut carpet and like fabric into smaller sections. These cutters normally produced a single vertical cut which caused problems in binding and/or overedging of the cut fabric.

Therefore, it is an object of the invention to provide a carpet cutting machine which provides carpet sections which have a beveled edge at the point of severance.

Other objects and advantages of the invention will become readily apparent as the specification proceeds to described the invention with reference to the accompanying drawings, in which.

Figure 1:
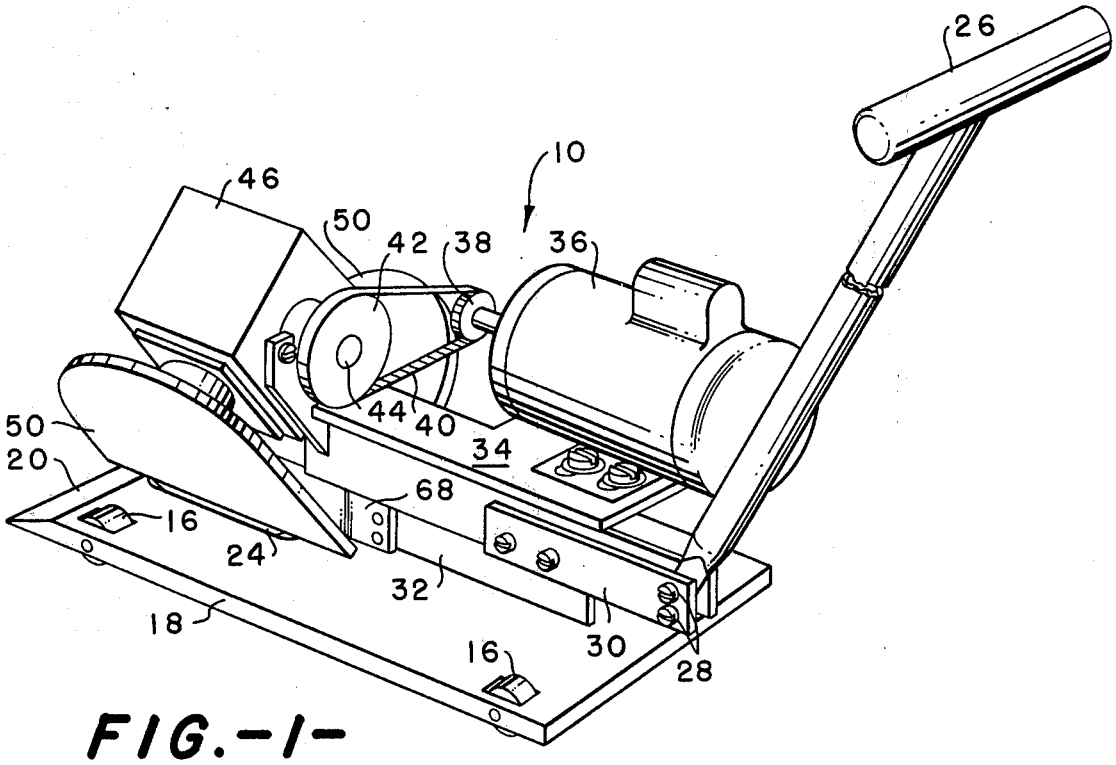
FIG. 1 is a schematic, isometric view of the carpet cutting machine.
Figure 4:
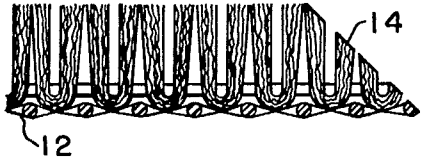
FIG. 4 is a cross-section view of a section of pile fabric cut by the machine of FIGS. 1-3.

Normally carpets are tufted, woven or bonded in wide widths and are cut to desired size for sale as area rugs. When the carpets are cut, it is necessary to treat the cut, raw edge in some manner to prevent the fibers therein from unraveling or being pulled out. Prior to this invention, most carpets were cut with a vertical cutting line, which, in the case of binding was difficult to handle or in the case of overedging, the fibers tended to protrude through the yarn used to overedge the carpet. Therefore, the machine represented by reference numeral 10 in FIG. 1, was invented to provide a carpet 12, having a upstanding fiber surface and a backing material, with an edge 14 beveled at an angle of approximately 45° as shown in FIG. 4.

The carpet cutting machine is portable and is moved on wheels 16 rotably supported on base plate 18, the front edge 20 of which is beveled downward to guide the carpet to be cut onto the top of the plate 18 and under the rotating cutting blades 22 and 24. The carpet to be cut slides over the plate 18 as the machine 10 is pushed forward through the use of handle 26 secured by suitable screws 28 to support members 30 and 32. Mounted on the support member 32 is a plate 34 to which is secured a motor 36 which rotates the cutting blades 22 and 24 in the same direction through sprocket 38, timing belt 40, sprocket 42, drive shaft 44 and gear box 46. Suitable guards 50 are located over the rotating blades 22 and 24 to prevent accidental injury to an operator.

Figure 2:
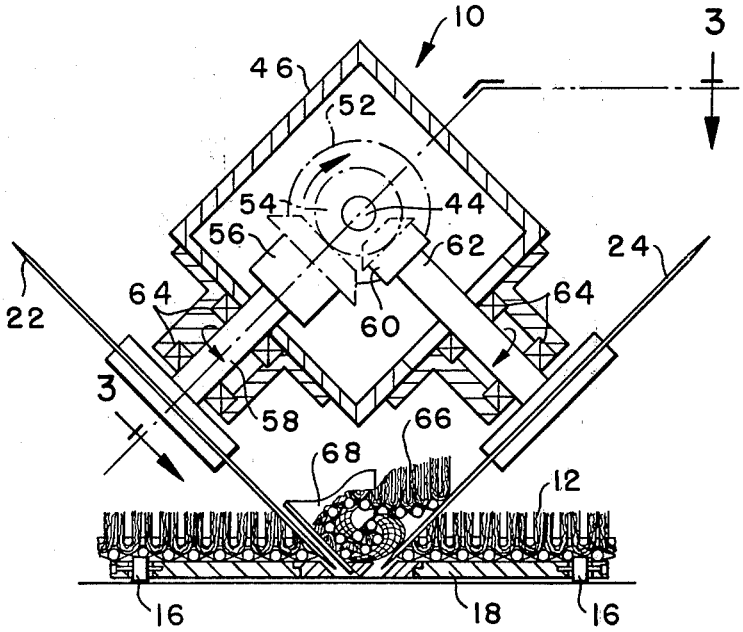
FIG. 2 is front, partial section view with parts removed to show the cutting blades and the drive therefrom.
Figure 3:
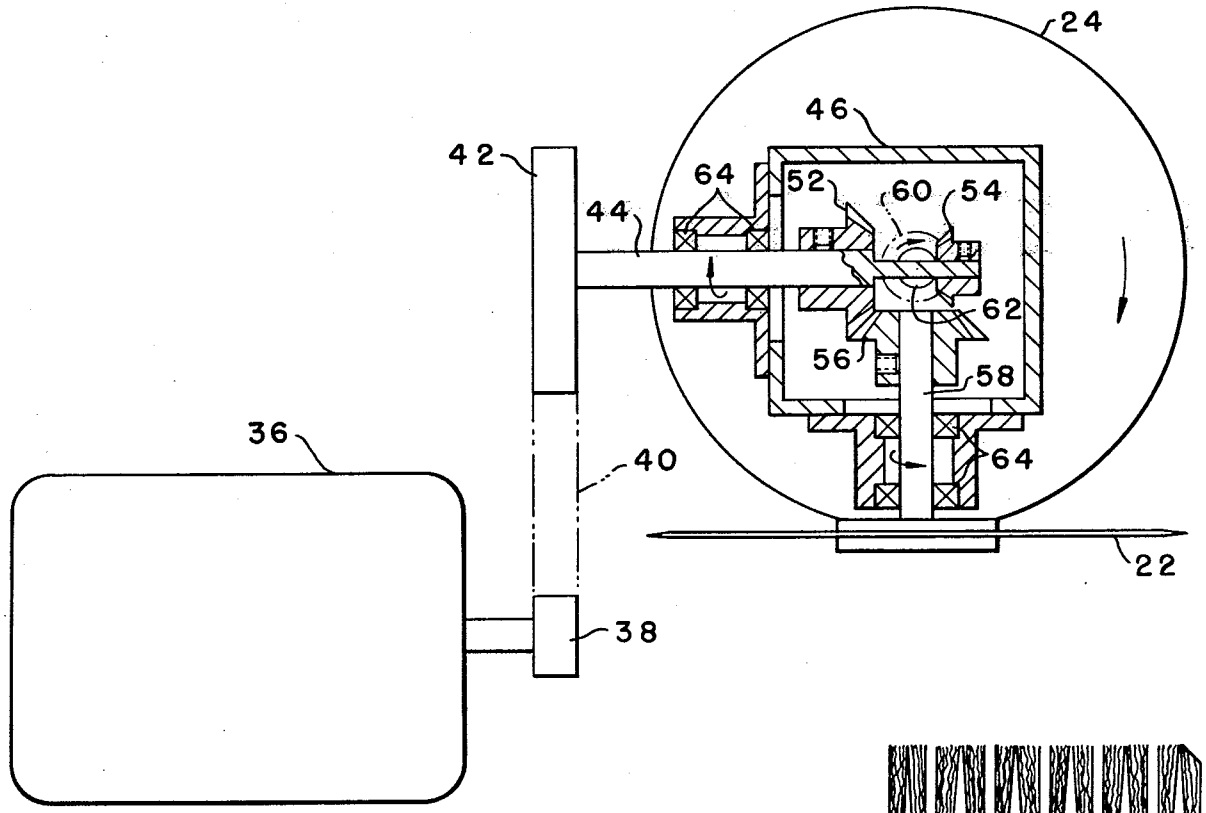
FIG. 3 is a section view taken on line 3—3 of FIG. 2.

Looking now to FIGS. 2 and 3, the gear box 46 is shown in detail. As discussed previously, the cutter blades 22 and 24 are both rotated in the same direction at the same speed. This is accomplished by two bevel gears 52 and 54 connected to driven shaft 44 but not connected to each other. Bevel gear 52 engages bevel gear 56 secured to shaft 58 to rotate cutting blade 22 while bevel gear 54 engages bevel gear 60 secured to shaft 62 to rotate cutting blade 24. Since the bevel gears 52 and 54 are independently driven at the same speed and have the same gear ratio as the driven gears 56 and 60, the cutter blades 22 and 24 will be driven in the same direction at the same rate of speed. The shafts 44, 58 and 62 are suitably secured in the gear box 46 by suitable bearings 64.

It should be noted that the axis of the shafts 58 and 62 are substantially perpendicular to one another and that the gear box 46 is so mounted that the blades 22 and 24 are inclined at an angle to the carpet 12 and the base plate of about 45°. This provides a beveled edge 14 of approximately 45°.

To insure that the carpet scrap 66 cut from the carpet at the separation point is guided away from the blades efficiently a guide 68 is mounted between the tips of the cutting blades 22 and 24 to guide the carpet scrap 66 rearwardly and always in the same position to prevent the scrap from flapping back and forth.

It can readily be seen that a carpet machine has been described which will efficiently provide pieces of cut carpet with a beveled edge for ease of further processing without creating a problem of ravelled carpet edges.

Although I have described the specific method and apparatus to provide a carpet with a beveled edge, it is contemplated that many changes may be made without departing from the scope or spirit of the invention and I desire to be limited only by the scope of the claims.

I claim:

1. The method of providing a plurality of carpet pieces from a wide width of carpet comprising the steps of: supplying a wide width of carpet to be cut, guiding the carpet to be cut onto the support plate of a portable cutting machine into position adjacent a pair of cutting blades mounted at an angle to each other and moving the support plate and the cutting blades forward to cut a small section of the carpet from the wide width of carpet while guiding the small section cut from the carpet in a direction away from the direction of movement of the support blade and cutting blades to provide two smaller pieces of carpet with the edges thereof cut at an angle to the plane of the carpet.

2. The method of claim 1 wherein the carpet edges are cut at an angle of approximately 45°.

* * * * *